US006726561B2

(12) United States Patent
Crawford

(10) Patent No.: US 6,726,561 B2
(45) Date of Patent: Apr. 27, 2004

(54) SYSTEM AND METHOD OF PLAYING A CARD GAME

(76) Inventor: Curtis Crawford, 280 Plaza Carmelina Ct., Henderson, NV (US) 89014

( * ) Notice: Subject to any disclaimer, the term of this patent is extended or adjusted under 35 U.S.C. 154(b) by 0 days.

(21) Appl. No.: 10/426,373

(22) Filed: Apr. 29, 2003

(65) Prior Publication Data

US 2003/0195026 A1 Oct. 16, 2003

Related U.S. Application Data

(63) Continuation of application No. 09/941,967, filed on Aug. 28, 2001.

(51) Int. Cl.[7] ..... A63F 1/00

(52) U.S. Cl. ..... 463/13; 273/292; 273/138.1

(58) Field of Search ..... 463/11–13, 16, 463/20–21; 273/292, 138.1, 139, 207, 274

(56) References Cited

U.S. PATENT DOCUMENTS 4,836,553 A 6/1989 Suttle et al. ..... 273/292
5,531,448 A 7/1996 Moody ..... 273/292
5,863,041 A 1/1999 Boylan et al. ..... 273/292
5,882,260 A 3/1999 Marks et al. ..... 463/13
5,964,464 A 10/1999 Jones ..... 273/292
6,176,781 B1 1/2001 Walker et al. ..... 463/13
6,237,916 B1 5/2001 Webb ..... 273/292
6,334,613 B1 1/2002 Yoseloff ..... 273/292
6,419,578 B1 7/2002 Moody et al. ..... 463/13
6,443,455 B1 9/2002 Webb ..... 273/274
6,467,771 B1 10/2002 deKeller ..... 273/274
6,474,646 B1 11/2002 Webb ..... 273/274
6,517,074 B1 2/2003 Moody et al. ..... 273/292
6,533,279 B2 3/2003 Moody et al. ..... 272/292
6,568,680 B1 5/2003 Moody et al. ..... 273/292

*Primary Examiner*—S. Thomas Hughes
*Assistant Examiner*—Alex F. R. P. Rada, II
(74) *Attorney, Agent, or Firm*—Seed IP Law Group PLLC

(57) ABSTRACT

A system and method of playing a card game are provided where a hand of cards is evaluated in accordance with the rules of play as a composite of hands. The original hand of cards is first evaluated collectively, and then in addition sub-combinations of the cards, such as three-card sub-combinations, four-card sub-combinations, and the like are evaluated.

17 Claims, 16 Drawing Sheets

SYSTEM AND METHOD OF PLAYING A CARD GAME

TECHNICAL FIELD

This application is a Continuation of pending U.S. patent application Ser. No. 09/941,967, filed Aug. 28, 2001.

BACKGROUND OF THE INVENTION

1. Field of the Invention

The present invention pertains to card games, and, more particularly, to a system and method of playing a card game in which an original hand is evaluated as a composite of multiple hands.

2. Description of the Related Art

Most card games typically involve dealing each player an original hand of cards. This original hand is evaluated in accordance with game rules in which all of the cards are considered together as a single hand.

For example, in a basic poker game, which is played with a standard 52-card deck, each player is dealt five cards. All five cards in each player's hand are evaluated as a single hand for the presence of various combinations of the cards, such as pairs, three-of-a-kind, straights, etc. Determining which combinations prevail over other combinations is done by reference to a table containing a ranking of the combinations. The rankings in most tables are based on the odds of each combination occurring in the player's hand. Regardless of the number of cards in a player's hand, the values assigned to the cards, and the odds, the method of evaluating all five cards in a player's hand remains the same.

A modified poker card game is described in U.S. Pat. No. 5,882,260 where each player has more than five cards in a hand. Each player builds at least two five-card hands that are placed on a playing surface and joined by an intersecting card to define a pattern. This method has the disadvantage of requiring each player to be dealt at least 9 cards at a time. Because all cards are placed on the playing surface in a pattern, substantial space on the playing surface is required for each player.

BRIEF SUMMARY OF THE INVENTION

The disclosed embodiments of the invention are directed to a system and method of card game play. In accordance with one method of card game play, five cards are dealt to a player. The five cards are evaluated as a five-card hand and in addition as a sub-combination hand of fewer cards than the five cards in accordance with the rules of play. For example, in a game of five-card draw poker, a hand of five cards is dealt to a player and the hand is evaluated as a five-card hand and in addition as at least a sub-combination hand of the at-least five cards, such as a three-card hand, a four-card hand, or both, or as two three-card hands, or as three three-card hands, all in accordance with the rules of play. Ideally the method of card game play is implemented electronically, such as on an electronic gaming machine, a portable handheld device, a stand-alone game machine, a personal computer, and other devices that are commercially available and as known to those skilled in the art.

In accordance with another aspect of the invention, the method of card game play includes dealing an initial five-card hand to the player, replacing any cards discarded by the player at the player's option, and evaluating the hand as a five-card hand and, in addition, evaluating pre-determined three-card and four-card sub-combinations as three-card and four-card hands, respectively, in accordance with the rules of play. Alternatively, the hand of five cards can either be evaluated as two three-card hands, two four-card hands, or as three three-card hands. Moreover, the foregoing embodiment can involve initially dealing four cards to the player, in which case the hand would be evaluated as a four-card hand and as one or more three-card hands.

In accordance with another embodiment of the method of card game play, the method includes receiving at least five cards and evaluating the at least five cards as a five-card hand and evaluating sub-combination hands of the at least five cards to have less than the at least five cards, such as three-card hands, four-card hands, or as a combination of a two-card hand and a three-card hand, or as three three-card hands, or a three-card hand along with a four-card hand. As discussed above, this method of card game play can be implemented on a computer.

In accordance with yet another embodiment of the invention, a method of card game play is provided, the card game having rules of play associated with it. The method includes receiving a wager placed by a player; providing the player with at least five cards; receiving an additional wager at the player's option; replacing cards selected by the player at the player's option from the player's hand; and evaluating the at least five cards as a single at least five-card hand and in addition evaluating the at least five cards as a sub-combination hand of fewer than the at least five cards, such as four cards or three cards. In one embodiment of the invention, the at least one sub-combination hand includes two sub-combination hands, each of which may be three cards or one of which is three cards and the other of which is four cards, or each of which is four cards. Other sub-combinations are also possible depending on the number of cards initially provided to the player.

In accordance with a system of the present invention, a computer is provided that is configured to deal at least five cards to a player and evaluate the at least five cards as a five-card hand and in addition as a sub-combination hand of cards, such as three cards and four cards, in accordance with rules of play that are stored on a storage device associated with the computer. Ideally the at least five cards are provided to the player on a display device, such as a monitor.

As will be appreciated from the foregoing, the embodiments of the invention enhance card game play by enabling play of three-card hands, four-card hands, or both, within and in addition to the five-card hand. This increases not only the player's opportunity to place additional wagers and increase their winnings, it also provides increased income opportunities for the provider of the game.

BRIEF DESCRIPTION OF THE SEVERAL VIEWS OF THE DRAWING(S)

The foregoing and other features and advantages of the disclosed embodiments of the invention will be more readily appreciated as the same become better understood from the accompanying detailed description when taken in conjunction with the following drawings, wherein.

DETAILED DESCRIPTION OF THE INVENTION

The disclosed embodiments of the invention will be described in conjunction with the playing of a five-card draw poker card game. However, it is to be understood that the system and method of the present invention will have application to other card games, and, more particularly, to card games having a hand of two or more cards where sub-combinations of the cards can be individually evaluated as a hand of cards in addition to the original hand of all of the cards.

In one embodiment of the invention, an enhancement to five-card draw poker is provided. The enhancement enables the playing of a sub-combination of cards within and in addition to the original hand of cards. For example, the player is dealt five cards. The original five-card hand is evaluated and, in addition, a sub-combination of three cards can be separately evaluated as a three-card hand and, further in addition or in the alternative, a four-card sub-combination is evaluated as a four-card hand. Various other sub-combinations of cards from the original hand can also be played together, such as a sub-combination of a three-card hand and a sub-combination of a four-card hand in addition to the original five-card hand. Winning hands are determined by the ranking of each of the three-card, four-card, and five-card combinations.

Figure 1:
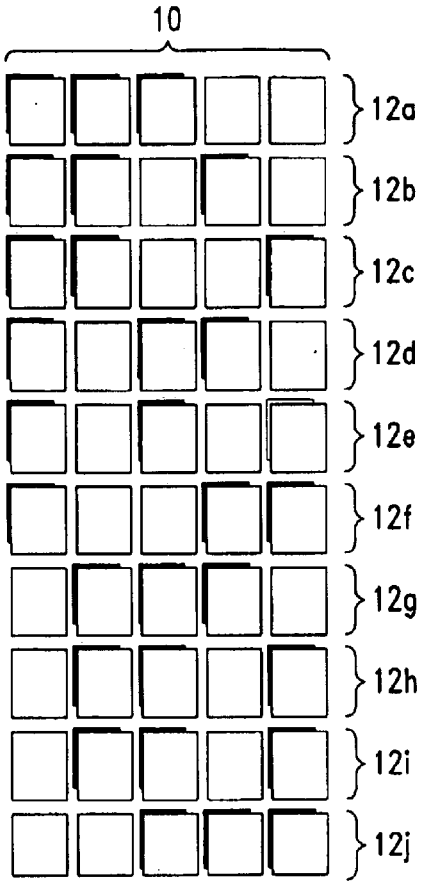
FIG. 1 illustrates possible three-card sub-combinations of a five-card hand in accordance with the present invention.
Figure 2:
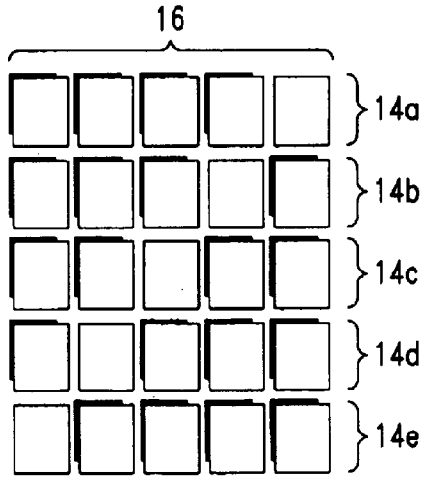
FIG. 2 illustrates possible four-card sub-combinations of a five-card hand.

Ideally, the sub-combination of cards is determined in advance. For example, as shown in FIG. 1, in an original five-card hand 10 there are ten possible sub-combinations of three-card hands 12*a* through 12*j*, with the three-card sub-combinations 12*a* through 12*j* shown as an offset shadow of the original card. FIG. 2 illustrates the five possible four-card sub-combination hands 14*a*–14*e* that are possible within an original five-card hand 16. As shown in FIG. 2, the original five-card hand is illustrated as an individual row with the four-card sub-combination hand 14*a* shown as an offset shadow of the original five-card hand 16.

It is to be understood that while three-card sub-combination hands and four-card sub-combination hands have been illustrated, the original five-card hand can have other sub-combinations, such as a two-card sub-combination hand. And with a greater number of cards in the original hand, such as six or seven, the number of sub-combinations increases, as will be obvious to one of ordinary skill in the art. Moreover, various combinations of the sub-combinations can be played simultaneously with the original hand, such as using a first three-card sub-combination hand 12*a* along with a second three-card sub-combination hand 12*j* that are evaluated concurrently with the original five-card hand 10. Other combinations of the sub-combinations will be evident to one of ordinary skill.

Thus in playing a game of five-card draw poker, the method of the present invention includes dealing or providing to each player an original hand of five cards. In one embodiment each player may place a wager prior to receiving the initial five-card hand. Once each player receives the original hand of at least five cards, the player may, at the player's option, discard and replace any or all of the original at least five cards.

At this point, each player may place an additional wager or continue with their original wager. However, this additional wager may be eliminated in games where it gives the player too much of an advantage.

The player's hand is then evaluated for the presence of pairs, three-of-a-kind, straights, and the like as is well known in rules of playing five-card draw poker. Because there are many variations of poker, the original hand of five cards is evaluated in accordance with the rules of the game then being played. In addition to evaluating the original five-card hand, each player evaluates the sub-combination hands as previously determined and in accordance with the rules. The winning hand is determined by a ranking of each of the original five-card hand and the sub-combination hands. For example, the original five-card hand is evaluated along with a three-card sub-combination hand, such as the first three cards in the hand as shown in sub-combination 12*a*. Additional sub-combinations can be included, such as four-card hand 14*a* shown in FIG. 2. Each of the hands are evaluated and ranked according to the rules of play.

Figure 3:
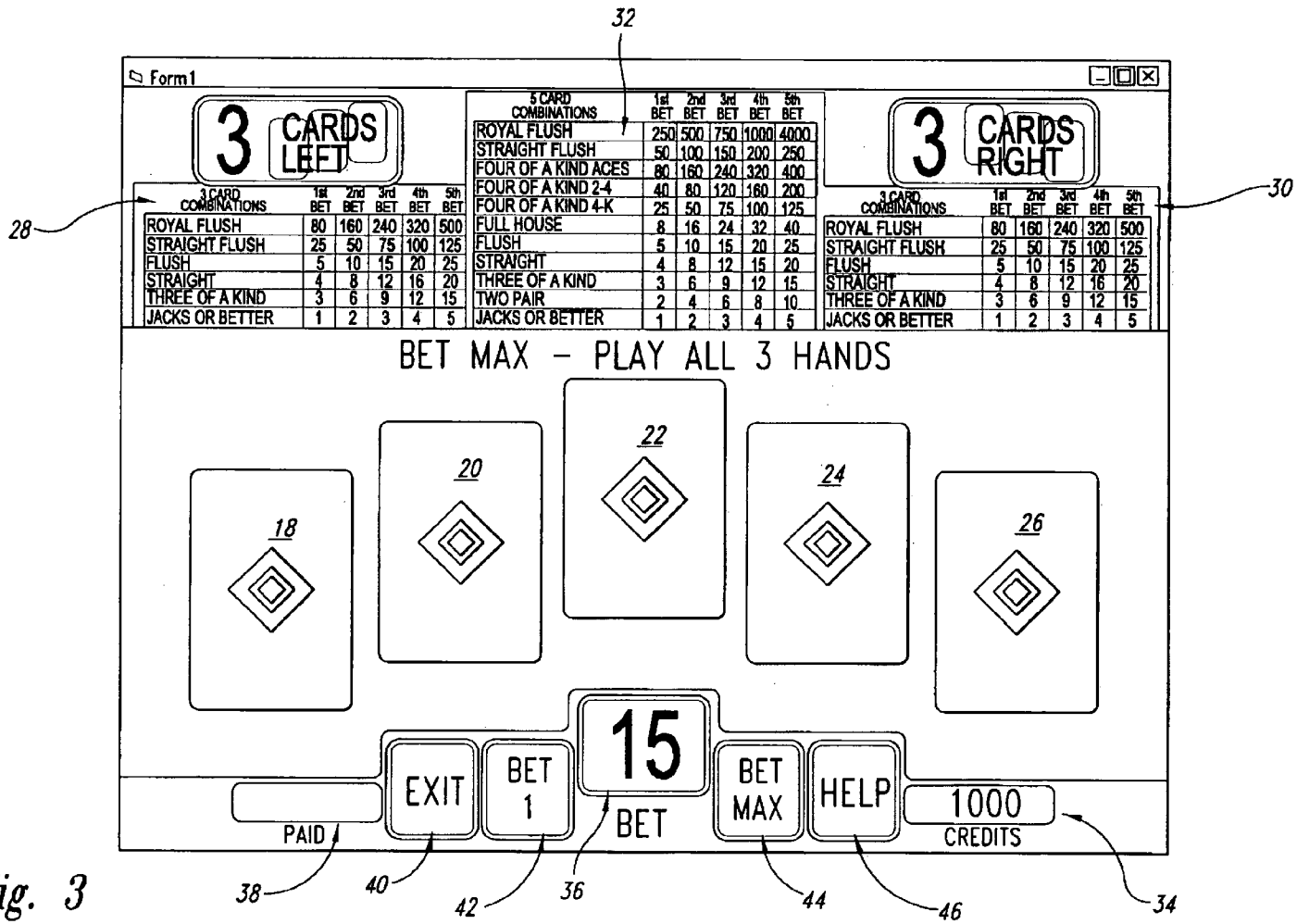
FIGS. 3–17 are illustrations of electronic screen displays showing in sequence the method of playing the card game in accordance with the present invention.

Referring next to FIG. 3, illustrated therein is a representative example of an electronic version of the method of playing the game formed in accordance with the system of the present invention. This electronic version may be played on a personal computer, electronic game machine, portable handheld device, or other electronic device that is readily commercially available or is known to those skilled in the art.

As shown in FIG. 3, five cards 18, 20, 22, 24, and 26 are initially displayed to the player face down. Above these five cards are three columns, the first column 28 headed "3 CARDS LEFT," and the right column 30 headed "3 CARDS RIGHT." The center column 32 does not have a heading and is identified by its position between the left and right columns 28, 30. All three columns 28, 30, 32 display the payout associated with various combinations of cards in a typical hand of five-card draw poker. In this embodiment of the invention, the payout for bets on the five-card combinations in the center column 32 include more possible combinations than are in the left and right columns 28,30. This is because the center column 32 evaluates five cards and the left and right columns 28,30 evaluate only three cards.

Each column 28, 30, 32 is further divided into five additional columns headed "1st BET," "2nd BET," "3rd BET," "4th BET," and "5th BET." Each column represents the number of credits being bet for that particular combination of cards. The numbers listed with a particular combination under the columns indicate the payout in credits when that particular combination of cards is present. For example, in the center column 32, under "1$^{st}$ BET," a Royal Flush will pay 250 credits for one wagered credit, 500 credits for two wagered credits, 750 credits for three wagered credits, 1000 credits for four wagered credits, and 4000 credits for five wagered credits.

Below the five displayed cards are windows and buttons to display information and enable selections by the player, respectively. The total credits available for wagering are displayed in the "CREDITS" window 34 on the lower right portion of the display. The total credits wagered are displayed in the "BET" window 36 at the lower center of the display. The total credits paid for the current hand are displayed in the "PAID" window 38 at the lower left of the display.

The buttons include an "EXIT" button 40 to the right of the PAID window 38. In the electronic version of the system, clicking on this button exits from the game. A "BET 1" button 42 is located adjacent and to the right of the EXIT button 40. Clicking on this button initiates a wager of one credit, as will be explained in more detail herein below. TO the right of the BET window is a "BET MAX" button 44 that, when clicked, wagers the maximum number of credits in each of the three columns 28,30,32, which in this embodiment is five credits for each column 28,30,32.

Figure 4:
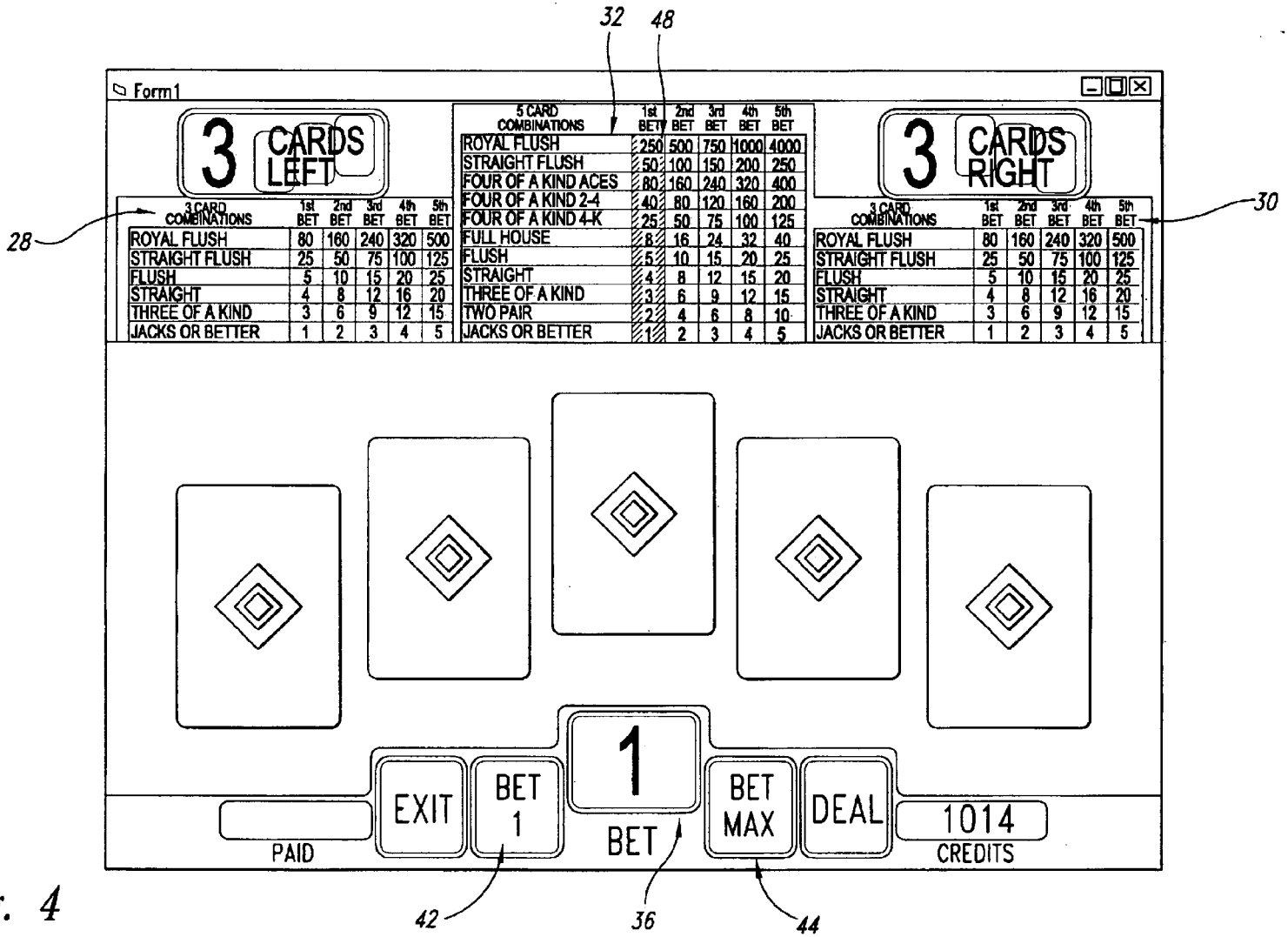
Figure 5:
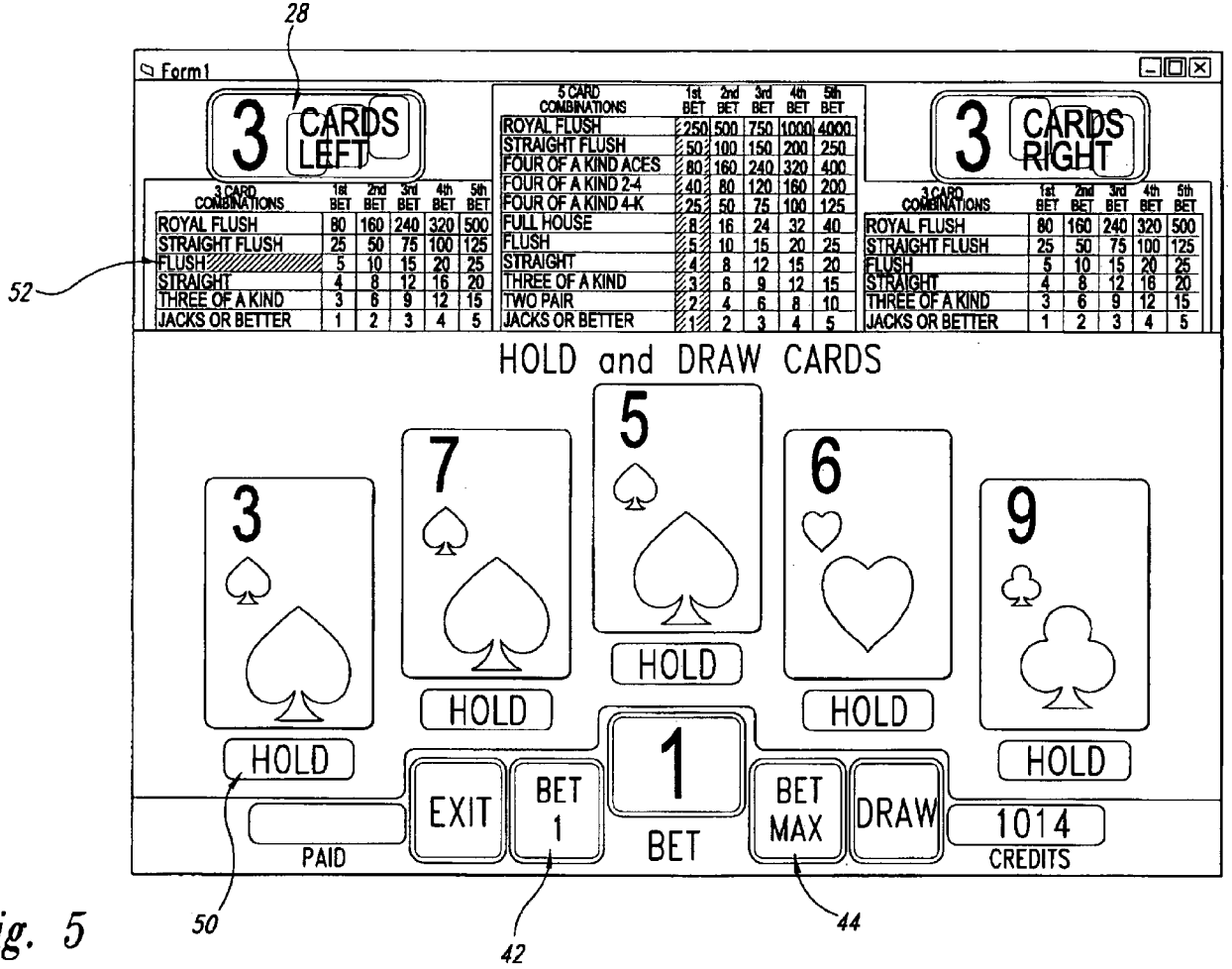

Positioned between the BET MAX button 44 and the CREDITS window 34 is a multi-function button 46. As shown in FIG. 3, this button is labeled "HELP" and, when clicked, displays a message to the player regarding game play. The message can be a general display of the rules of play, or it can be situation specific to the current condition of the game display, such as explaining the player's options. As shown in FIG. 4, this multi-function button 46 is labeled "DEAL," and when clicked by the player it initiates dealing or displaying of the initial five cards to the player. In FIG. 5, the multi-function button is labeled "DRAW," and when clicked it initiates replacing of cards not held by the player, as described in more detail herein below.

To initiate game play, the player selects the BET 1 button 40 or the BET MAX button 44 to place a wager of one or more credits. Preferably, the player selects the button by using a mouse device (not shown) in a conventional manner. Referring to FIG. 4, the BET 1 button 40 has been clicked, and the $1^{st}$ BET column 48 in the center column 32 has been highlighted. In addition, the number of credits wagered is shown as "1" in the BET window 36. No wagers have been made on the left or right 3-card columns 28,30.

The player may select the BET 1 button 40 again and depress it or click on it to place additional wagers of credits, as desired, or may commence with dealing the cards by clicking on the multi-function button 46, currently labeled "DEAL." In this example of game play, the "DEAL" button 46 has been clicked, freezing the wager at 1 credit and, as shown in FIG. 5, displaying the playing faces of the five cards. When the cards are displayed, a "HOLD" button 50 appears beneath each of the cards. At this point the player may elect to hold one or more of the five original cards by clicking on the HOLD button 50 beneath the desired card.

In the example shown in FIG. 5, the three left cards, the 3, 7, and 5 are all spades, resulting in a "flush." This is brought to the player's attention by highlighting the "FLUSH" combination 52 on the left column 28 for the left three cards. However, no wager was made on the three left cards. At this point, the player has the option of changing the wager to include the left three cards or both the left three and the right three cards. Even though the BET 1 button 40 and the BET MAX button 44 are no longer highlighted, they may be selected or clicked on to increase the wager.

It is to be understood that while in this embodiment the left column 28 will not accept wagers until the maximum wager is placed on the center column 32, and the right column 30 will not accept wagers until the center column 32 and the left column 28 have the maximum wager placed therein, other methods for controlling the placement of wagers may be used without departing from the spirit and scope of the invention. For example, the BET 1 button may be configured to make the first credit wagered on the center column 32, the second credit wagered on the left column and the third credit wagered on the right column 30. Alternatively, the wagers may be completely controlled by the player via the mouse through pointing and clicking.

Figure 6:
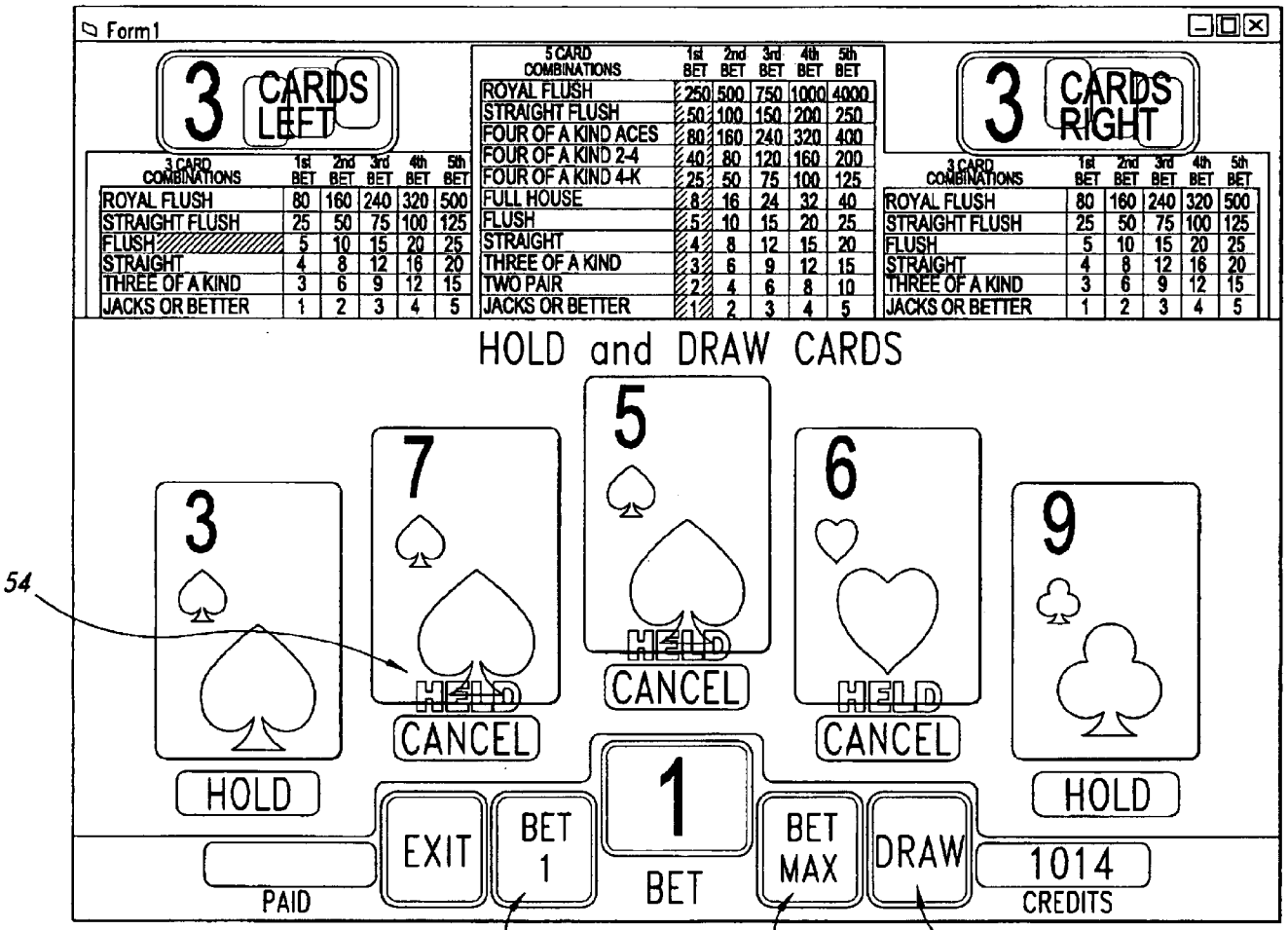

In this example, however, the wager is not changed. Instead, the middle three cards are held, as shown in FIG. 6, by clicking on the "HOLD" buttons 50 associated with the cards selected to be held. The legend "HELD" 54 appears at the lower portion of each card selected by the player to be held. The player then clicks on the "DRAW" button 46 to replace the cards not held.

Figure 7:
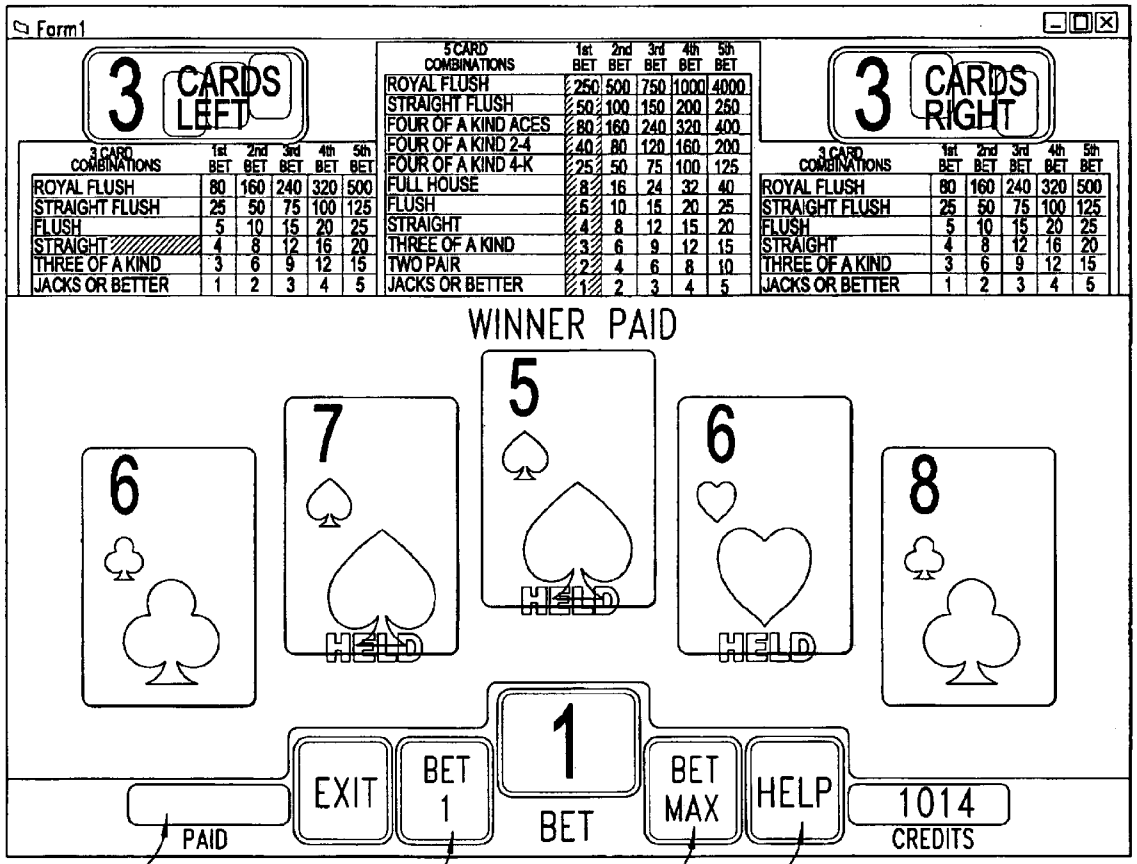

When the DRAW button 46 is clicked, the non-held cards are replaced, as shown in FIG. 7. The final hand is evaluated as a five-card hand only because only 1 wager was placed in the center column 32. Because none of the combinations listed in the center column 32 occurred, no credits are paid to the player, as shown by the empty PAID window 38. The multi-function button 46 changes to read "HELP" at this time, and the BET 1 button 42 and the BET MAX button 44 are highlighted along with the HELP button 46 to indicate a wager may be placed for the next hand.

Figure 8:
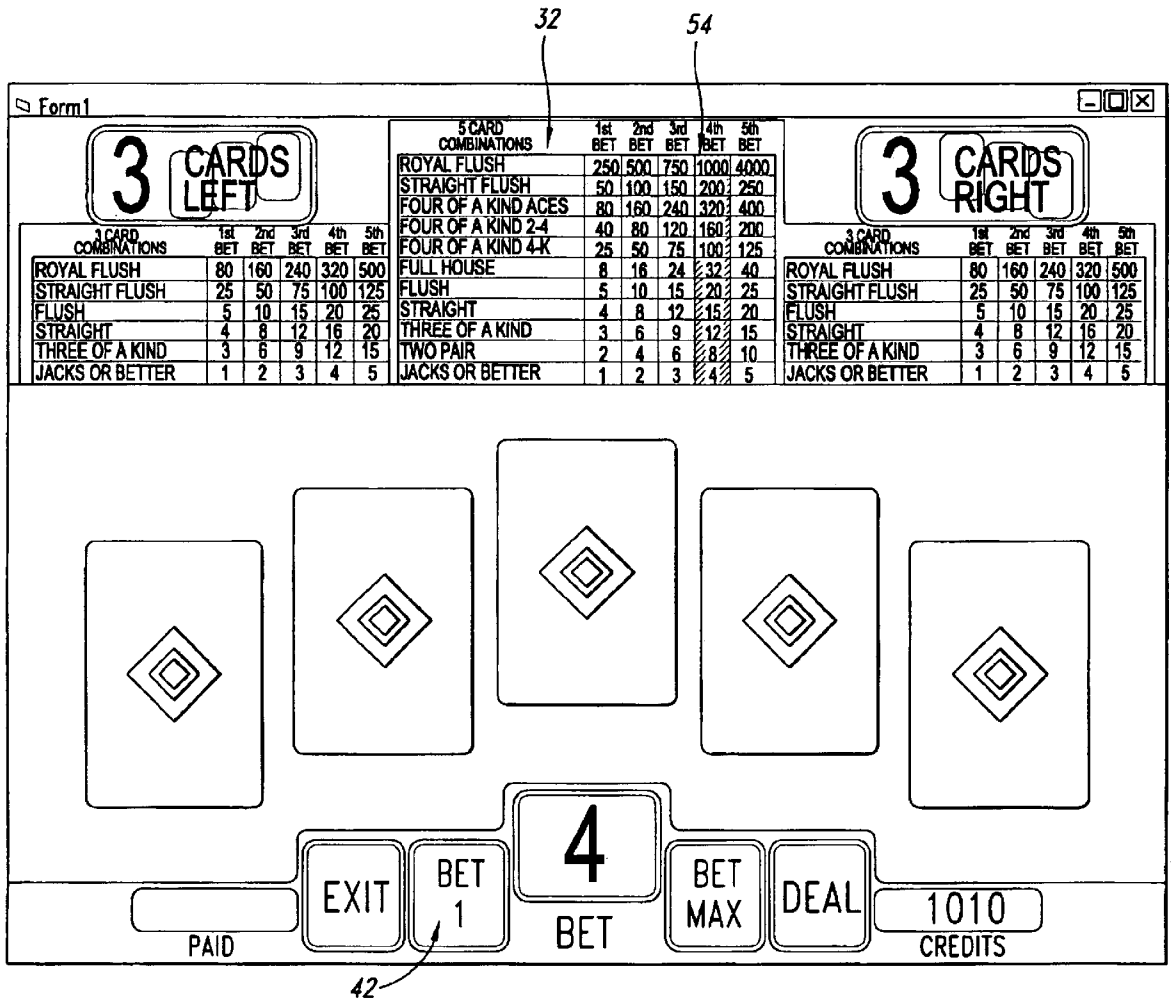
Figure 9:
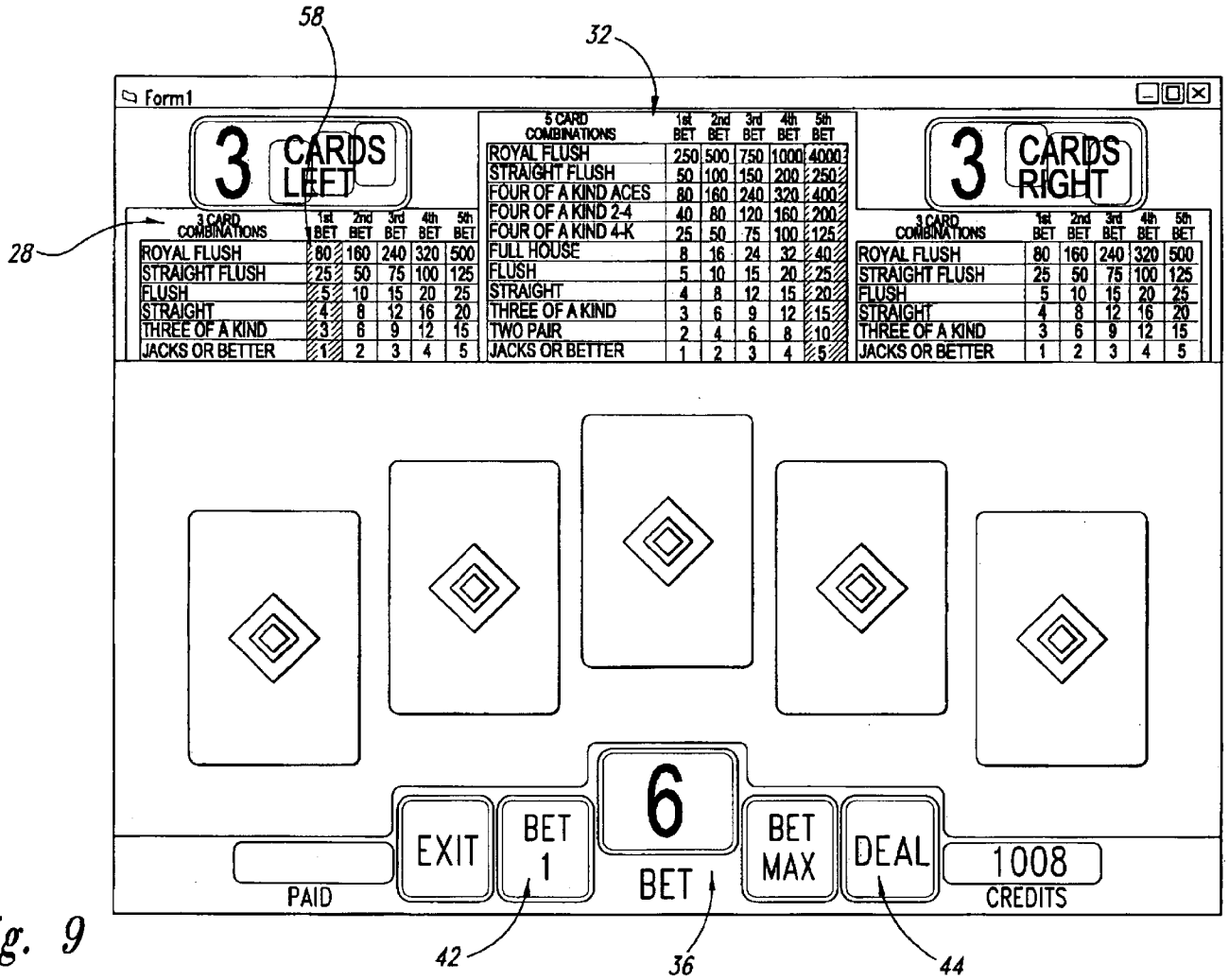
Figure 10:
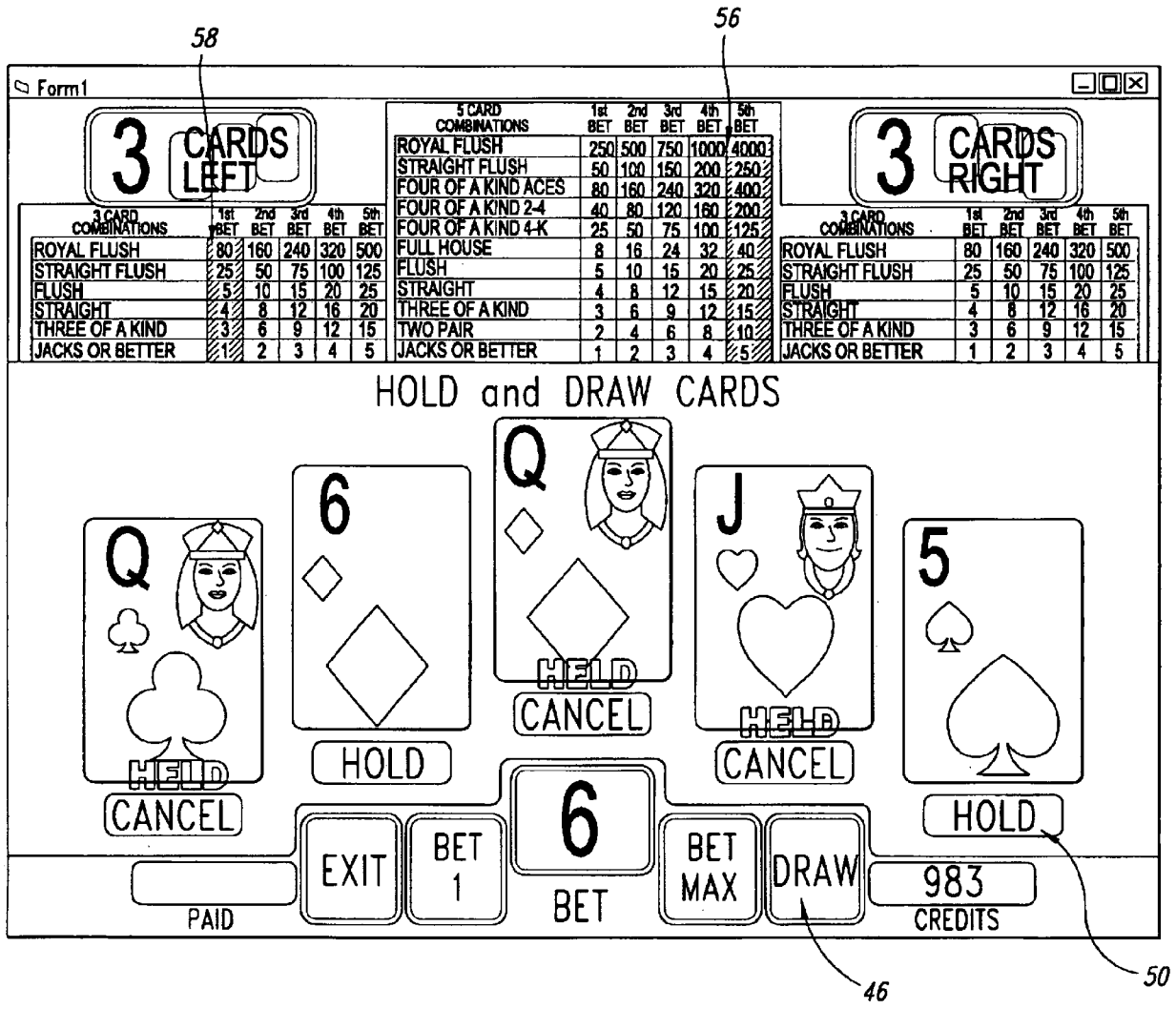

Referring next to FIG. 8, as shown herein, four credits have been wagered as shown by the highlighted $4^{th}$ BET column 54 in the center column 32. Further clicking on the BET 1 button 42 results in the $5^{th}$ BET column being highlighted to show the maximum wager for the middle column 32 and, in addition, a one credit wager being registered under the $1^{st}$ BET column 58 in the first column 28 as shown in FIG. 9. A total wager of 6 credits has now been made, as confirmed in the BET window 36. Clicking on the DEAL button 46 results in the five cards being displayed, as shown in FIG. 10.

At this point, the presence of the pair of Queens in the three left cards results in the "Jacks or Better" combination being highlighted. In addition, this same combination is highlighted in the center column 32 for the original five-card hand. The two Queens and the Jack are selected for holding by clicking on their respective HOLD buttons 50. When the HOLD button 50 is clicked, the HOLD button 50 changes its text to read "CANCEL." Clicking on the CANCEL button 50 toggles the selection back to releasing the card from a held status and changes the button text to read "Hold."

Figure 11:
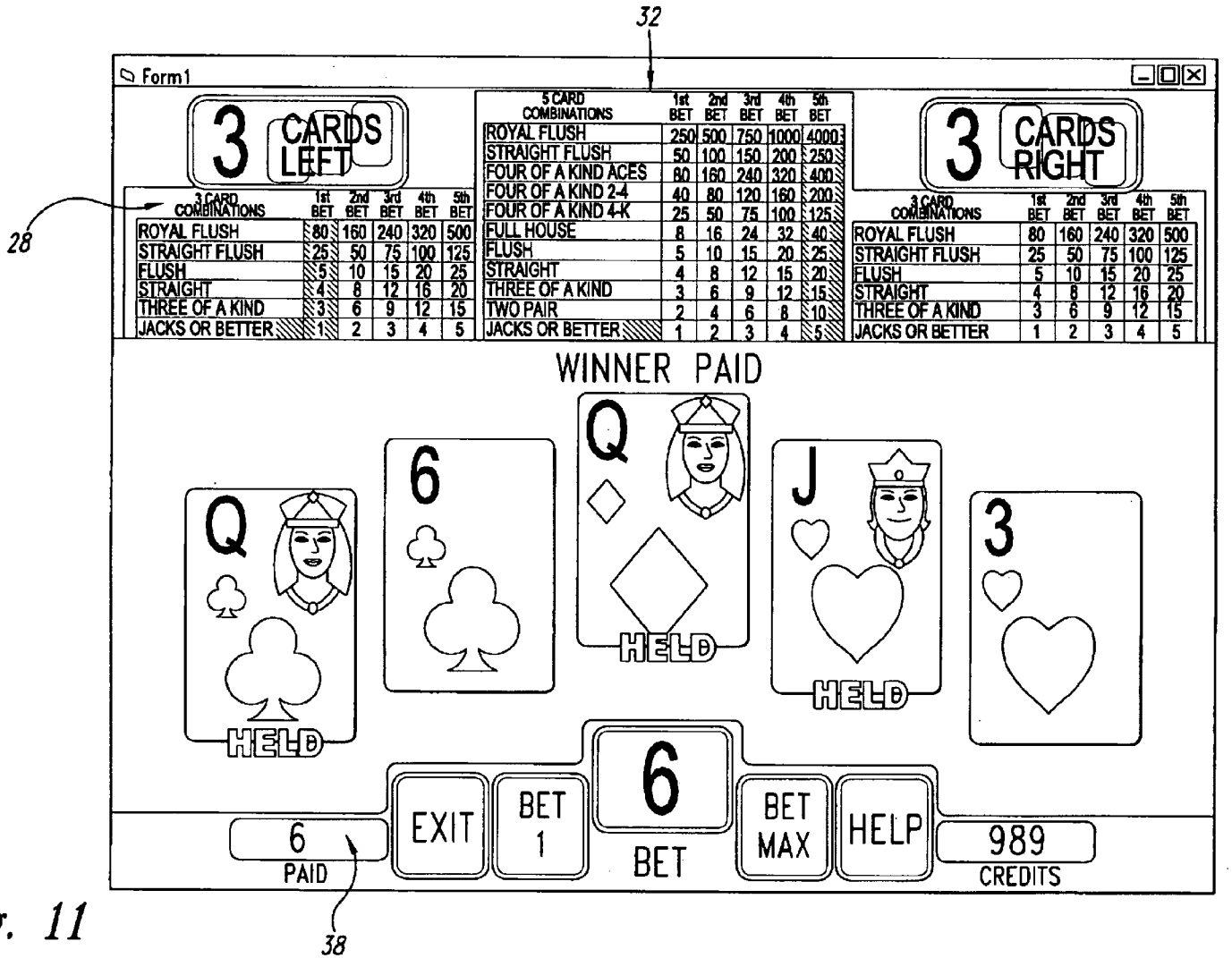

Clicking on the DRAW button 46 results in replacement of the non-held cards, in this case a 6 of diamonds and a 5 of Spades, with a 6 of Clubs and a 3 of Hearts. This does not improve the payout, and the game is configured to award the credits to the player, as shown in FIG. 11. The awarded credits are shown in the PAID window 38 as 6, which corresponds to the 5 credits paid out from the center column 32 and the 1 credit from the left column 28.

Figure 12:
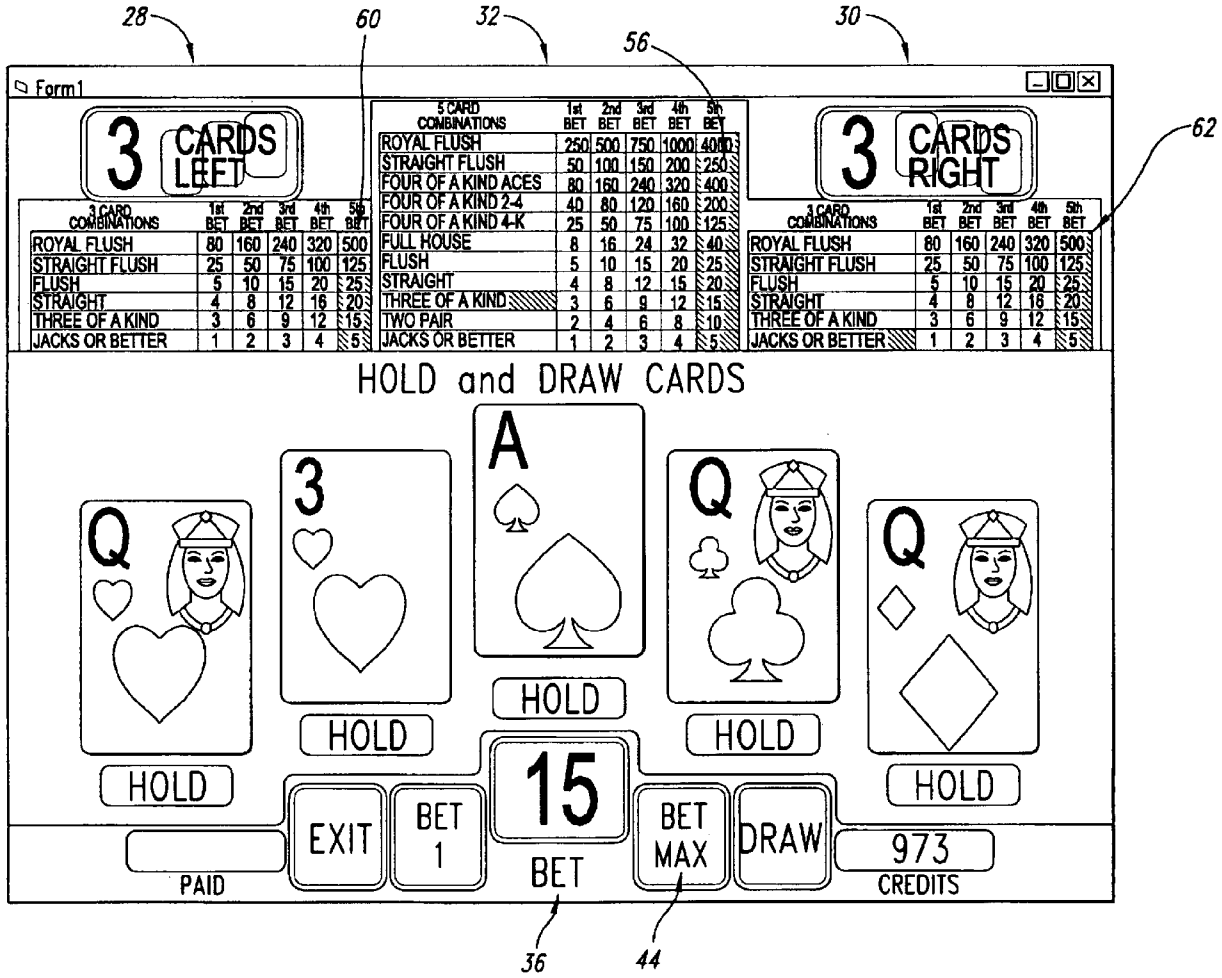
Figure 13:
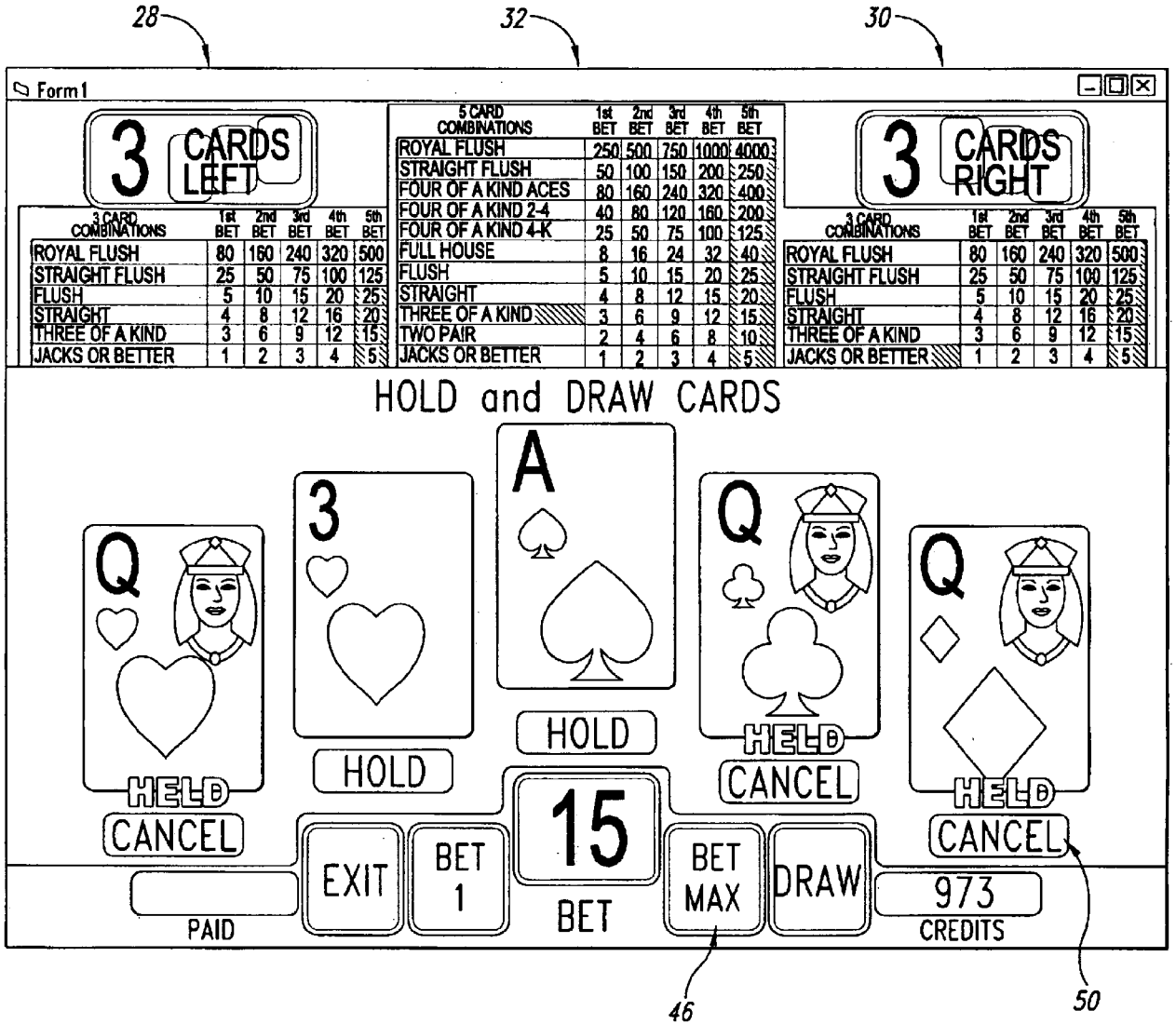
Figure 14:
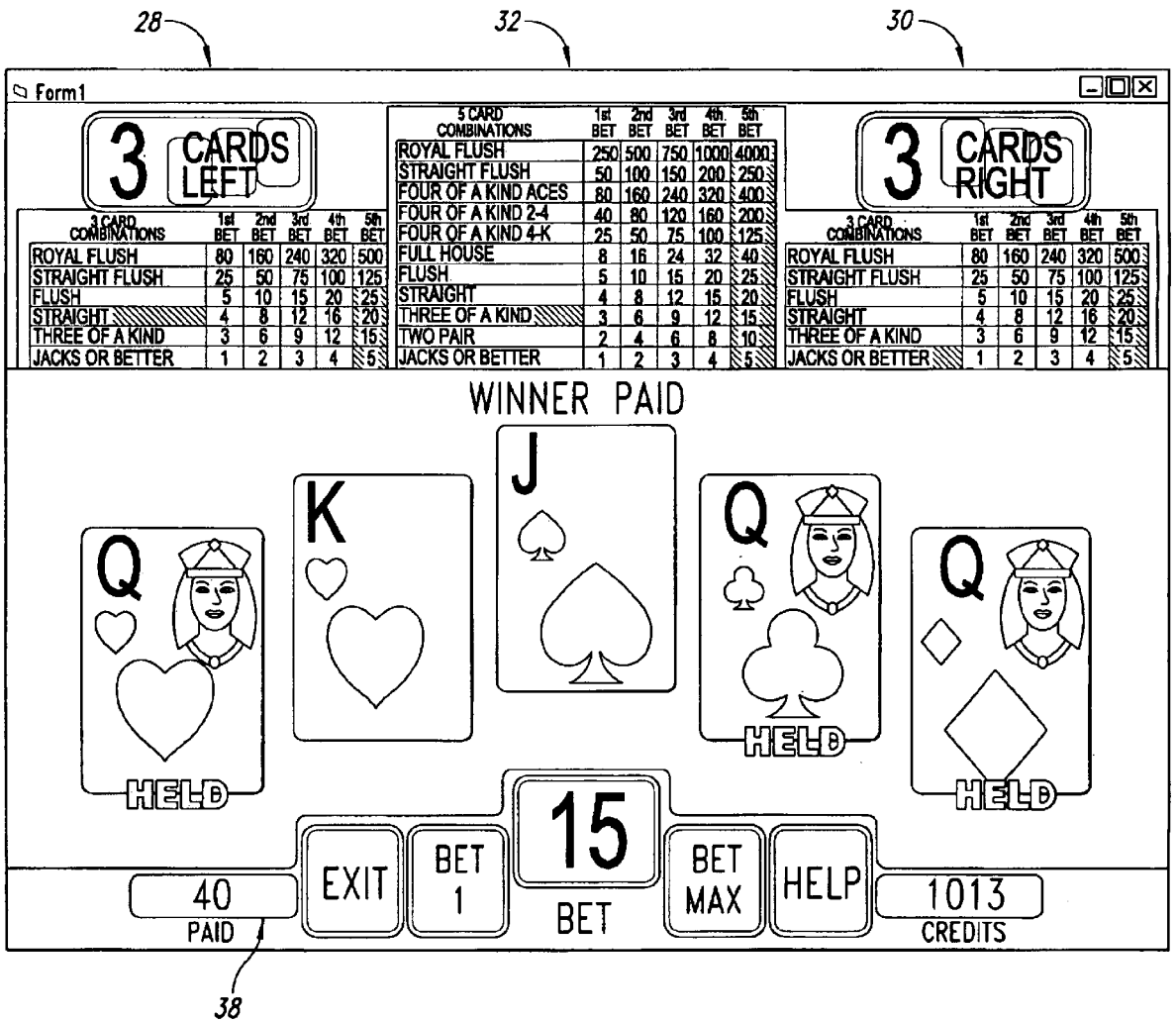

FIG. 12 shows the game display when the BET MAX button is clicked. The $5^{th}$ BET columns 56, 60, and 62 are highlighted simultaneously in the center column 32, the left column 28, and the right column 62, respectively. The BET window 36 shows a total of 15 credits wagered. The system is configured to automatically display the hand of five cards without further button selection because the maximum bet has been placed. As shown in FIG. 13, the three Queens have been selected to be held because they result in a "three of a Kind' in the center column 32 and "Jacks or Better" in the right column 30.

Pressing the DRAW button 46 results in the replacement of the non-held cards, the 3 of Hearts and the Ace of Spades, with a King of Hearts and a Jack of Spades. The resulting straight of the Jack, Queen, King in the three left cards of the left column 28 pays out 20 credits; the "Three of a Kind" in the center column 32 pays out 15 credits; and the pair of Queens in the right column 30 pays out 5 credits. The total of 40 credits is shown in the PAID window 38.

Figure 15:
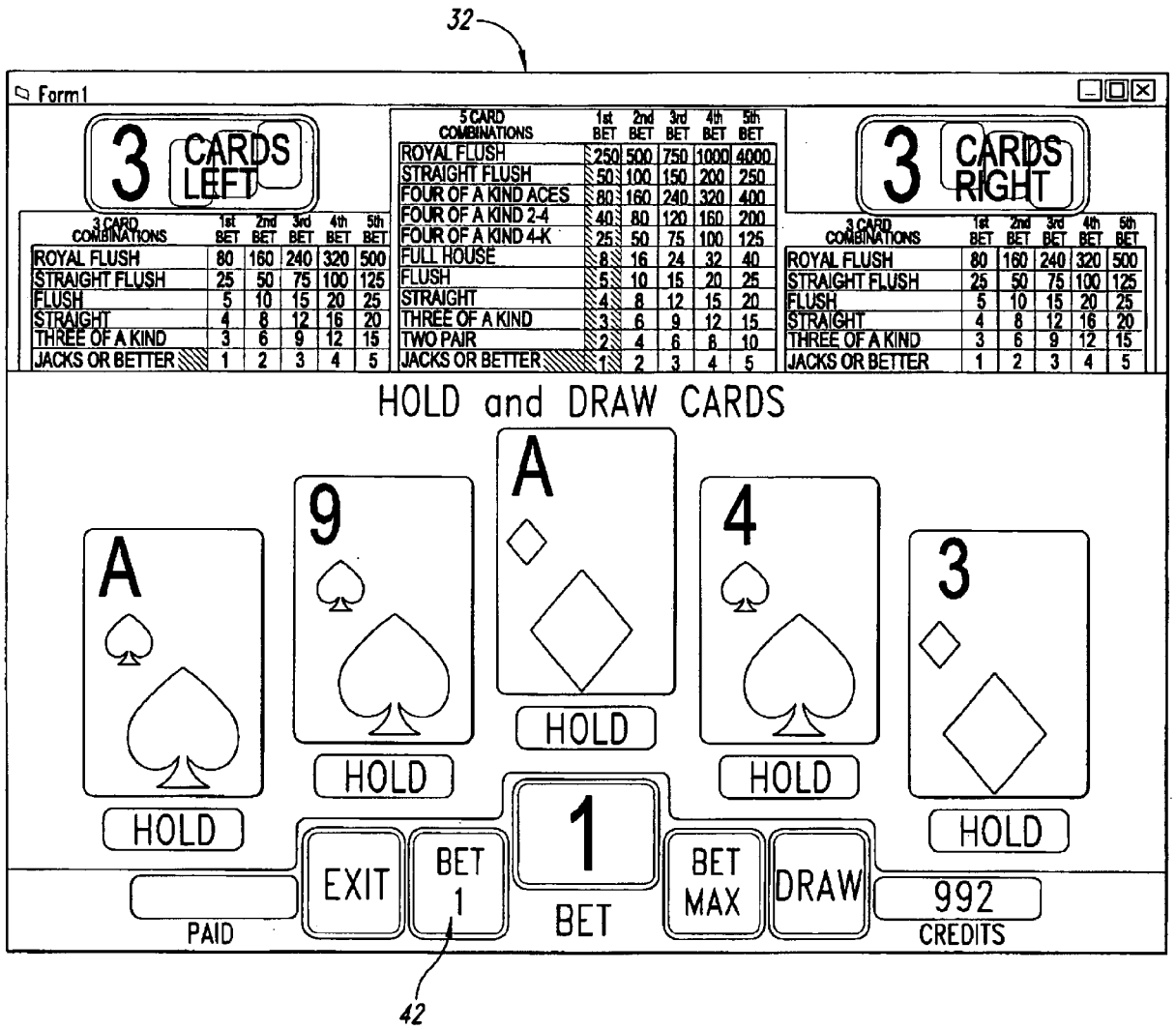
Figure 16:
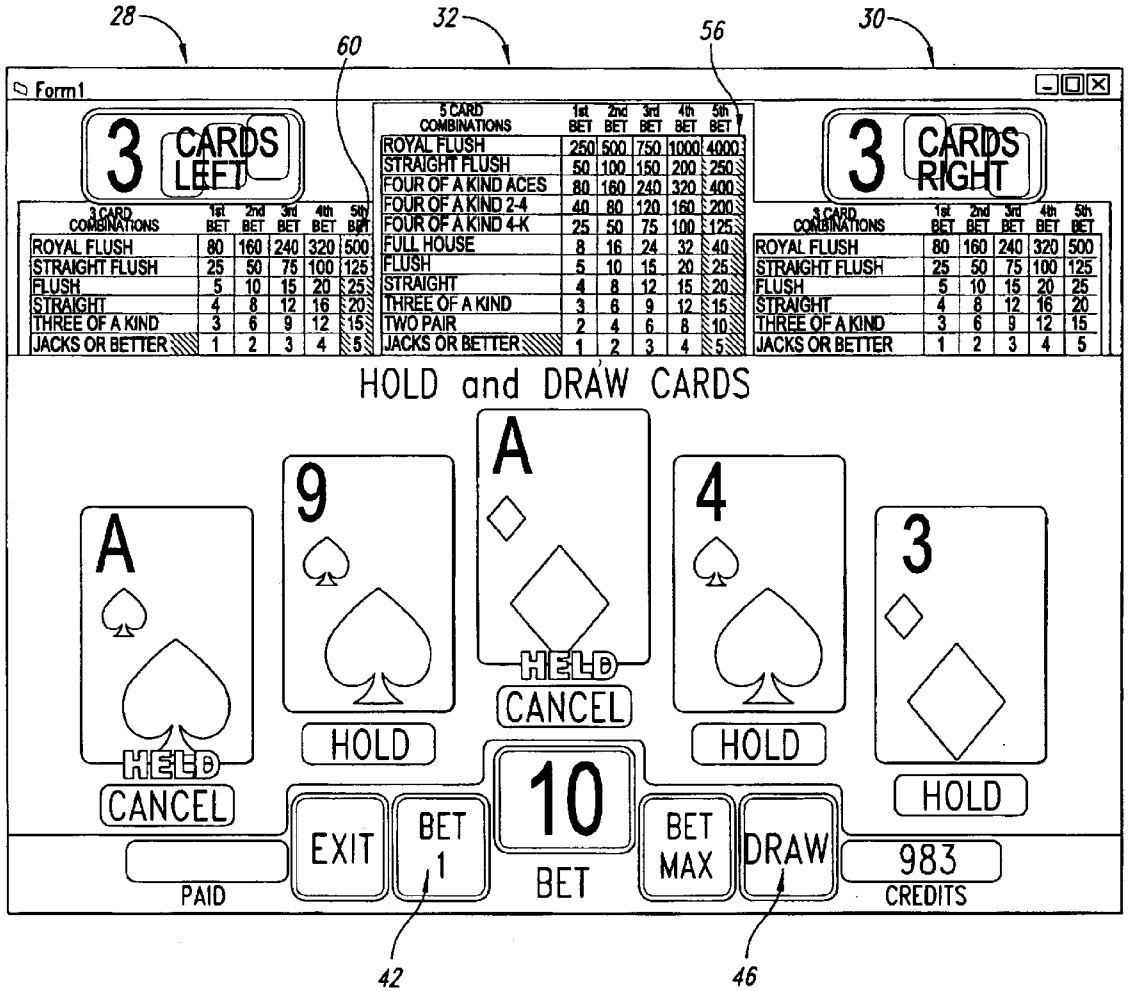
Figure 17:
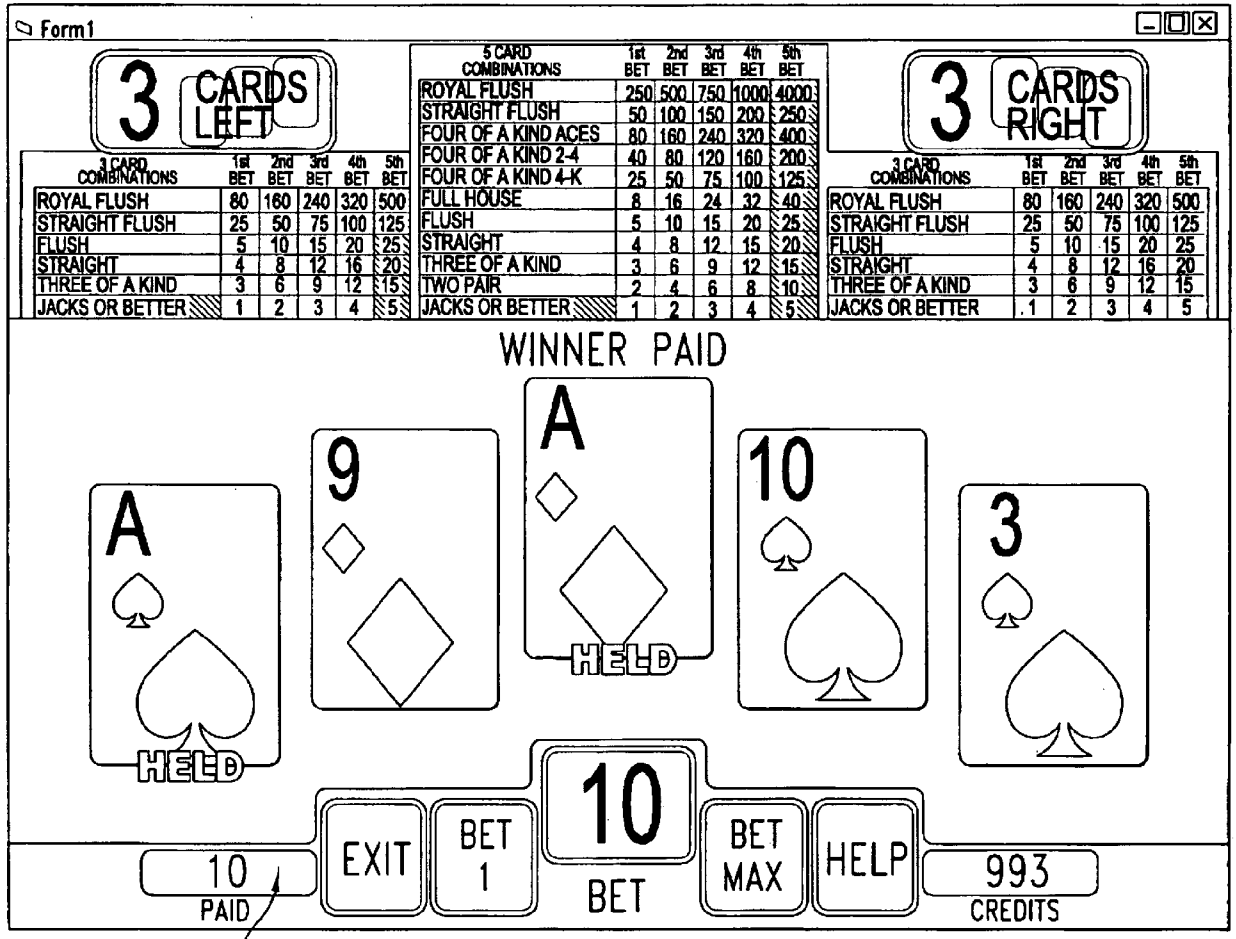

FIGS. 15–17 show the sequence of play when a wager is increased after the initial five-card hand is displayed. In FIG. 15, a 1-credit wager is shown in the center column 32. The original five-card hand shows an Ace of Spades, a 9 of Spades, an Ace of Diamonds, a 4 of Spades, and a 3 of Diamonds, resulting in "Jacks or Better" in the left column 28 and the center column 32. Clicking of the BET 1 button 42 nine times causes the maximum wager of 5 credits to be made for the five-card hand, as shown in the center column 32, and a maximum wager of 5 credits to be made in the left column 28.

The pair of Aces is then selected to be held, and the DRAW button 46 is clicked to replace the other three non-held cards, which is shown in FIG. 16. The three cards are replaced with a 9 of Diamonds, a 10 of Spades, and a 3 of Spades. This yields no better combinations than the original pair of Aces, resulting in a payout of 10 credits, as shown in the PAID window 38 in FIG. 17.

While the foregoing system and method of the present invention has been described in the context of an electronic gaming machine as a preferred embodiment, the game may also be implemented as a table game. Multiple players seated around a table are dealt cards face down and play proceeds as described above with respect to FIGS. 3–17 in the electronic version. Because of the limited number of cards in a single deck, and the possibility of that a player could discard the original five cards and receive five replacement cards, the number of players will of necessity have to be limited to five or less.

All of the above U.S. patents, U.S. patent application publications, U.S. patent applications, foreign patents, foreign patent applications and non-patent publications referred to in this specification and/or listed in the Application Data Sheet are incorporated herein by reference, in their entirety.

From the foregoing it will be appreciated that, although specific embodiments of the invention have been described herein for purposes of illustration, various modifications may be made without deviating from the spirit and scope of the invention. For example, textual messages may be displayed to the player throughout the game. This can be seen in FIG. 3 where the message "BET MAX—PLAY ALL 3 HANDS" appears. In FIG. 5 the message "HOLD AND DRAW CARDS" appears, advising players on their options. Accordingly, the invention is not limited except as by the appended claims and the equivalents thereof.

What is claimed is:

1. A method of card game play, the card game having one set of rules of play, comprising:

dealing five cards to a player;

replacing any of the five cards as selected by the player; and evaluating the remaining five cards as a single five-card hand and evaluating four cards of the five cards as a four-card hand and determining a total evaluation by combining the evaluation of the five cards and the evaluation of the four cards in accordance with the same rules of play.

2. A method of card game play, the card game having one set of rules of play, the method comprising:

dealing five cards to a player;

replacing any of the five cards as selected by the player; and evaluating the remaining five cards as a single five-card hand and evaluating three cards of the five cards as a three-card hand and determining a total evaluation by combining the evaluation of the five cards and the evaluation of the three cards in accordance with the same rules of play.

3. A method of card game play, the card game having one set of rules of play, the method comprising:

dealing five cards to a player;

replacing any of the five cards as selected by the player; and evaluating the remaining five cards as a single five-card hand and evaluating three cards of the five cards as a three-card hand and evaluating four cards of the five cards as a four-card hand and determining a total evaluation by combining the evaluations of the five cards, four cards, and three cards in accordance with the same rules of play.

4. A method of card game play, the card game having one set of rules of play, the method comprising:

dealing five cards to a player;

replacing any of the five cards as selected by the player; and evaluating the remaining five cards as a single five-card hand and evaluating the five cards as at least two three-card hands in accordance with the same rules of play wherein each of the at least two three-card hands has at least one card not in common with the remaining at least two three-card hands, and combining the evaluations of the five-card hand and at least two three-card hands to determine a total evaluation.

5. A method of card game play, the card game having one set of rules of play, the method comprising:

dealing a hand of at least four cards to a player;

replacing any of the at least four cards as selected by the player; and evaluating the remaining at least four cards as a single four-card hand and evaluating the at least four cards as at least one additional hand of cards having fewer than the at least four cards dealt to the player and combining the evaluations of the four-card hand and the at least one additional hand to determine a total evaluation in accordance with the same rules of play.

6. The method of claim 5 wherein the method is implemented by a computer.

7. A method of card game play, the card game having one set of rules of play, the method comprising:

dealing an initial five-card hand to a player;

replacing any cards discarded by the player;

evaluating the remaining five-card hand as a single five-card hand and in addition evaluating three-card and four-card sub-combinations of the five-card hand as a three-card hand and a four-card hand, respectively, and determining a total evaluation by combining the evaluations of the five-card hand, three-card hand, and four-card hand in accordance with the same rules of play.

8. The method of claim 7 wherein the method is implemented by a computer.

9. A method of game play, the game utilizing at least fifty-two unique components arranged in four suits of thirteen components, the method comprising:

providing rules of play for evaluating sets and subsets of components;

assigning a set of five components to at least one player;

evaluating the set of five components in accordance with the rules of play and evaluating at least one subset of he set of five components comprising no more than four of the five components in accordance with the rules of play to determine a final ranking; and determining a total evaluation for each at least one player by combining the evaluation of the set of five components and the evaluation of the at least one subset of the five components in accordance with the rules of play.

10. The method of claim 9 wherein the method is implemented on a computer.

11. The method of claim 9 wherein providing the rules of play comprises determining the number of subsets and the number of components in each subset, ranking of combinations of components in the set of five components, and ranking of combinations of components within each of the at least one subset of components.

12. The method of claim 9 wherein assigning comprises selecting the five components randomly from the at least fifty-two components.

13. The method of claim 12 wherein assigning comprises replacing cards discarded by the at least one player.

14. The method of claim 9 wherein evaluating at least one subset of the set of five components comprises evaluating a subset of at least four components of the set of five components.

15. The method of claim 9 wherein evaluating at least one subset of the set of five components comprises evaluating a first subset of three components and a second subset of three components, each of the first and second subsets of three components having at least one component of the five components in common.

16. The method of claim 15, further comprising determining a total evaluation for each at least one player that comprises combining the evaluation of the set of five components and the first and second subsets of three components.

17. A method of playing a modified game of poker, comprising:

providing rules of play for evaluating a five-card set of cards in accordance with a set of poker rules and subsets of the five-card set of cards in accordance with a modified set of poker rules, the rules providing a ranking of combinations of cards in the five-card set of cards and the subset of cards;

dealing an initial hand of five cards to each player of a plurality of players;

replacing cards discarded from the initial hand of five cards to form a five-card set of cards for each player; and evaluating the five-card set of cards and at least one subset of the five-card set of cards that comprises no more than four cards of the five-card set of cards, comprising evaluating the five-card set of cards in accordance with the set of poker rules and evaluating the at least one subset of cards in accordance with the modified set of poker rules and totaling the evaluation of the five-card set of cards and the at least one subset of cards to determine the player having the highest ranking in accordance with the rules of play.

* * * * *